US010207774B2

(12) United States Patent
Castello et al.

(10) Patent No.: US 10,207,774 B2
(45) Date of Patent: Feb. 19, 2019

(54) SYSTEMS AND METHODS FOR HEATING OIL STORED IN AN OFFSHORE VESSEL OR PRODUCTION PLATFORM

(71) Applicant: HORTON DO BRASIL TECHNOLOGIA OFFSHORE, LTDA., Houston, TX (US)

(72) Inventors: Xavier Castello, Rio Grande (BR); Marcelo I. L. Souza, Rio de Janeiro (BR); Rodrigo M. R. Guimarães, Rio de Janeiro (BR); Rafael Bodanese, Macaé (BR); Luiz Germano Bodanese, Rio de Janeiro (BR)

(73) Assignee: HORTON DO BRASIL TECHNOLOGIA OFFSHORE, LTDA., Houston, TX (US)

( * ) Notice: Subject to any disclaimer, the term of this patent is extended or adjusted under 35 U.S.C. 154(b) by 0 days.

(21) Appl. No.: 15/805,088

(22) Filed: Nov. 6, 2017

(65) Prior Publication Data

US 2018/0148137 A1 May 31, 2018

Related U.S. Application Data

(60) Provisional application No. 62/426,851, filed on Nov. 28, 2016.

(51) Int. Cl.
*E21B 36/00* (2006.01)
*E21B 43/36* (2006.01)
(Continued)

(52) U.S. Cl.
CPC ..... *B63B 25/08* (2013.01); *B63B 35/44* (2013.01); *B65D 88/54* (2013.01); *B65D 88/74* (2013.01); *B65D 88/78* (2013.01); *B65D 90/046* (2013.01)

(58) Field of Classification Search
CPC ..... E21B 36/00; E21B 43/36; B63B 25/08; B63B 35/44; B63B 35/4413; B65D 88/54; B65D 88/74; B65D 88/78; B65D 90/046
See application file for complete search history.

(56) References Cited

U.S. PATENT DOCUMENTS 2,349,536 A * 5/1944 Bancroft ..... E21B 36/00 166/61
2,636,490 A 4/1953 Miller
(Continued)

FOREIGN PATENT DOCUMENTS

WO 2014095777 A1 6/2014

OTHER PUBLICATIONS

PCT/US2017/060251 International Search Report and Written Opinion dated Jan. 11, 2018 (13 p.).

*Primary Examiner* — Matthew R Buck
(74) *Attorney, Agent, or Firm* — Conley Rose, P.C.

(57) ABSTRACT

A offshore system for storing oil includes a hull. The hull includes a buoyancy compartment and an oil storage compartment disposed below the buoyancy compartment. The oil storage compartment has an upper end, a lower end, and an inner cavity. In addition the system includes a water port in fluid communication with the inner cavity and configured to allow water to exit the inner cavity. Further, the system includes an oil heating and circulation system coupled to the hull. The oil heating and circulation system includes a suction line having an inlet disposed in the inner cavity proximal the upper end. The inlet is configured to draw oil from the inner cavity. The oil heating and circulation system also includes an oil heater coupled to the suction line and configured to heat oil passing through the suction line. Further, the system includes a return line coupled to the oil heater. The return line includes an outlet disposed in the
(Continued)

inner cavity and vertically positioned between the inlet of the suction line and the water port.

19 Claims, 7 Drawing Sheets

(51) Int. Cl.

| | |
|---|---|
| ***B63B 35/44*** | (2006.01) |
| ***B63B 25/08*** | (2006.01) |
| ***B65D 88/54*** | (2006.01) |
| ***B65D 88/74*** | (2006.01) |
| ***B65D 88/78*** | (2006.01) |
| ***B65D 90/04*** | (2006.01) |

(56) References Cited

U.S. PATENT DOCUMENTS

| | | | | |
|---|---|---|---|---|
| 2,914,124 | A * | 11/1959 | Ripley, Jr. | E21B 36/006 165/45 |
| 3,159,130 | A | 12/1964 | Vos | |
| 3,307,512 | A * | 3/1967 | Fell | B63B 27/24 114/74 R |
| 3,908,763 | A * | 9/1975 | Chapman | E21B 36/00 166/302 |
| 4,059,065 | A * | 11/1977 | Clark | B65D 88/78 114/256 |
| 4,641,710 | A * | 2/1987 | Klinger | E21B 36/00 166/266 |
| 5,435,262 | A | 7/1995 | Grinius et al. | |
| 6,564,873 | B1 | 5/2003 | Tilbrook et al. | |
| 8,011,312 | B2 * | 9/2011 | Finn | B63B 27/24 114/256 |
| 8,292,546 | B2 | 10/2012 | Wu | |
| 9,327,805 | B2 * | 5/2016 | Wang | B63B 35/4413 |
| 9,783,947 | B2 * | 10/2017 | Lee | E02L 317/02 |
| 9,828,072 | B2 * | 11/2017 | Gallagher | B63B 35/44 |
| 2004/0258484 | A1 | 12/2004 | Haun | |
| 2006/0004593 | A1 | 1/2006 | Seat et al. | |
| 2012/0248099 | A1 | 10/2012 | Nadarajah et al. | |
| 2014/0234029 | A1 | 8/2014 | Sweeney | |
| 2014/0248099 | A1 | 9/2014 | Frank et al. | |
| 2015/0041142 | A1 | 2/2015 | Wang et al. | |
| 2016/0186401 | A1 * | 6/2016 | Selwa | E21B 43/36 405/205 |

* cited by examiner

SYSTEMS AND METHODS FOR HEATING OIL STORED IN AN OFFSHORE VESSEL OR PRODUCTION PLATFORM

CROSS-REFERENCE TO RELATED APPLICATIONS

This application claims benefit of U.S. provisional patent application Ser. No. 62/426,851 filed Nov. 28, 2016, and entitled "Systems and Methods for Heating Oil Stored in an Offshore Vessel or Production Platform," which is hereby incorporated herein by reference in its entirety.

STATEMENT REGARDING FEDERALLY SPONSORED RESEARCH OR DEVELOPMENT

Not applicable.

BACKGROUND

Field of the Disclosure

This disclosure relates generally to oil storage. More particularly, it relates to oil storage compartments within offshore structures and vessels. Still more particularly, this disclosure relates to apparatus and methods for handling oil within offshore storage compartments.

Background to the Disclosure

Oil produced offshore may need to be temporarily stored at an offshore location if there is not any infrastructure such as a pipeline to export the produced oil as it is produced. In such cases, the produced oil is typically stored in an offshore storage tank, and is periodically offloaded to a transport vessel, such as a ship, which delivers the oil to a desired location. In one type of offshore storage tank, the produced oil is stored within a variable ballast tank provided in an offshore structure such as a cell spar, a semi-submersible platform, or buoyant tower. In some cases, the oil is stored directly over ballast water in the variable ballast tank.

BRIEF SUMMARY OF THE DISCLOSURE

Embodiments of offshore systems for storing oil are disclosed herein. In one embodiment, an offshore system for storing oil comprises a hull. The hull comprises a buoyancy compartment containing a gas. The hull also comprises an oil storage compartment disposed below the buoyancy compartment. The oil storage compartment has an upper end, a lower end, and an inner cavity disposed between the upper end to the lower end. The oil storage compartment is configured to store oil and water in the inner cavity. In addition, the system comprises a water port in fluid communication with the inner cavity of the oil storage compartment. The water port is configured to allow water to exit the inner cavity. Further, the system comprises an oil heating and circulation system coupled to the hull. The oil heating and circulation system comprises a suction line having an inlet disposed in the inner cavity proximal the upper end of the oil storage compartment. The inlet is configured to draw oil from the inner cavity. The oil heating and circulation system also comprises an oil heater coupled to the suction line and configured to heat oil passing through the suction line. Still further, the system comprises a return line coupled to the oil heater. The return line includes an outlet disposed in the inner cavity of the storage compartment. The outlet is vertically positioned between the inlet of the suction line and the water port.

Embodiments of methods for heating and circulating oil stored in an offshore structure are disclosed herein. In one embodiment, a method for heating and circulating oil stored in an offshore structure comprises (a) pumping oil stored in an inner cavity of a storage compartment to a heater. In addition, the method comprises (b) heating the oil with the heater during (a). Further, the method comprises (c) returning the oil from the heater to the inner cavity of the storage compartment after (b). The oil is returned to the inner cavity of the storage compartment at a location positioned vertically below a location where the oil is pumped from the inner cavity of the storage compartment. Embodiments of systems for heating and circulating oil stored in an offshore structure are disclosed herein. In one embodiment, a system for heating and circulating oil stored in an offshore structure comprises a buoyancy compartment disposed in a floating hull. In addition, the system comprises an oil storage compartment disposed in the floating hull below the buoyancy compartment. The oil storage compartment has an inner cavity configured to store oil. Further, the system comprises an oil suction line having an inlet disposed in the inner cavity. The oil suction line is configured to draw oil from the inner cavity through the inlet. Still further, the system comprises an oil heater coupled to the oil suction line and configured to heat oil passing through the oil suction line. Moreover, the system comprises a return line coupled to the oil heater and including an outlet disposed in the inner cavity of the oil storage compartment. The outlet is vertically positioned below the inlet of the oil suction line. The return line is configured to transport oil from the oil heater to the inner cavity of the oil storage compartment.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of the disclosed exemplary embodiments, reference will now be made to the accompanying drawings, wherein.

NOTATION AND NOMENCLATURE

Figure 1:
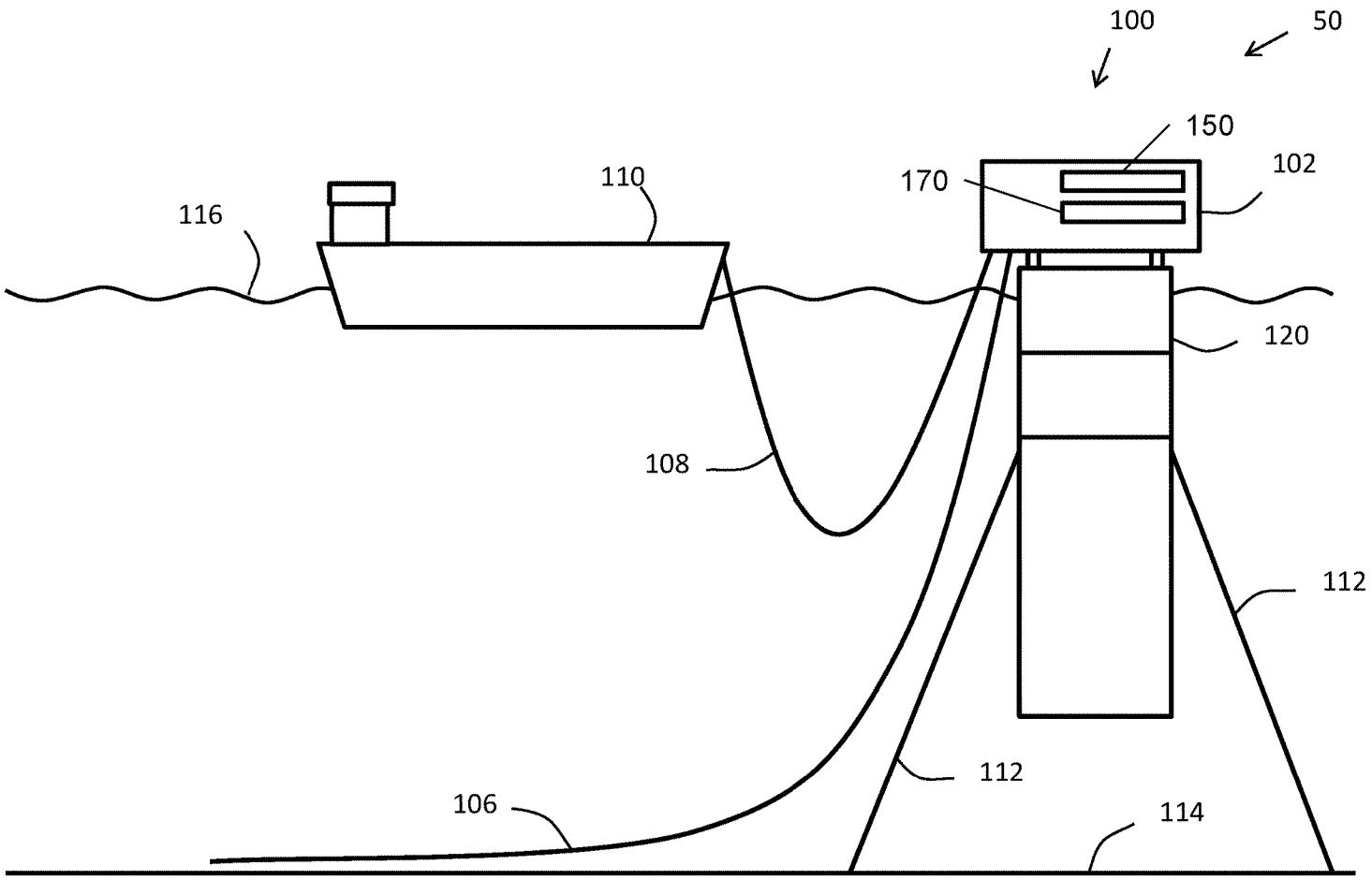
FIG. 1 is a schematic side-view of an embodiment of an oil storage system in accordance with the principles disclosed herein provided in a spar platform and coupled to a tanker.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The figures are not necessarily drawn to-scale. Certain features and components disclosed herein may be shown exaggerated in scale or in somewhat schematic form, and some details of conventional elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

As used herein, including in the claims, the terms "including" and "comprising," as well as derivations of these, are used in an open-ended fashion, and thus are to be interpreted to mean "including, but not limited to . . . ." Also, the term "couple" or "couples" means either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, then X may be based on Y and on any number of other factors. The word "or" is used in an inclusive manner. For example, "A or B" means any of the following: "A" alone, "B" alone, or both "A" and "B." In addition, the terms "axial" and "axially" generally mean along a given axis, while the terms "radial" and "radially" generally mean perpendicular to the axis. For instance, an axial distance refers to a distance measured along or parallel to a given axis, and a radial distance means a distance measured perpendicular to the axis. As understood in the art, the use of the terms "parallel" and "perpendicular" may refer to precise or idealized conditions as well as to conditions in which the members may be generally parallel or generally perpendicular, respectively. Furthermore, any reference to a relative direction or relative position is made for purpose of clarity, with examples including "top," "bottom," "up," "upward," "down," "lower," "clockwise," "left," "leftward," "right," "right-hand," "down", and "lower." For example, a relative direction or a relative position of an object or feature may pertain to the orientation as shown in a figure or as described. If the object or feature were viewed from another orientation or were implemented in another orientation, it may be appropriate to describe the direction or position using an alternate term. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

DETAILED DESCRIPTION OF THE PREFERRED EMBODIMENTS

As previously described, in remote offshore locations where a pipeline infrastructure is not available to export produced oil from an offshore production site, the produced oil may be temporarily stored at an offshore storage location prior to being transported with another vessel such as an oil tanker. The offshore storage location may be provided by a storage tank of an offshore structure. While awaiting transportation, the stored oil may cool. Such cooling may result from the transfer of thermal energy from the oil through the steel walls of the storage tank to the surrounding water and/or from the transfer of thermal energy from the oil directly to sea water in the storage tank in cases of oil-over-water storage. Transfer of thermal energy from the oil causes the temperature of the oil to decrease and the viscosity of the oil to increase. Depending on the composition of the oil, which may contain paraffins and/or asphaltenes for example, the cooled oil may result in the undesirably formation of deposits on the inside of the storage tank walls. Moreover, as the viscosity of the oil increases at lower temperatures, it become increasingly challenging to pump the oil from the storage tank to a transport vessel such as an oil tanker. However, as will be described in more detail below, embodiments of offshore oil storage systems and methods described herein offer the potential to reduce or eliminate such problems caused by the cooling of stored oil. In particular, embodiments described herein include systems and methods for heating and circulating stored oil to slow and/or prevent the decrease in temperature thereof.

Referring now to FIG. 1, an embodiment of an offshore oil production and storage system 100 is shown. In this embodiment, system 100 is a floating offshore structure including an adjustably buoyant spar-type hull 120 and a topsides or work deck 102 mounted atop hull 120. As will be described in more detail below, work deck 102 can support oil processing equipment such as an oil heater and a water monitor and treatment system for use in connection with oil and water disposed within hull 120. Storage system 100 is coupled to a fluid transfer conduit or riser line 106 that supplies oil to system 100 from a subsea well, a temporary storage well, or another production platform such as a floating production storage and offloading platform (FPSO), as examples. Periodically, system 100 is coupled to an oil transport vessel or tanker 110 via an oil offloading conduit or line 108. System 100 is held in position with a plurality of mooring lines 112 extending from system 100 to the seafloor 114. Transfer line 106 and offloading transfer line 108 are removably installed, as needed, to transfer produced oil to and from system 100, respectively.

In general, floating oil storage system 100 can be any type of floating offshore structure including, without limitation, part of a hull of a floating offshore platform (e.g., a portion of a column of a semi-submersible a hull, a portion of a hull of a spar platform, etc.) or a stand-alone floating offshore structure. Herein below, several different embodiments of floating oil storage systems 100 are described, the different embodiments being labeled 100A, 100B, 100C, 100D, 100E, 100F in the description and drawings. The embodiments of floating oil storage systems 100A, 100B, 100C shown in FIGS. 2, 3, and 4, respectively, are oil-over-water storage arrangements in which there is direct contact between sea water and the stored oil at an interface therebetween; whereas the embodiments of floating oil storage systems 100D, 100E, 100F shown in FIGS. 5, 6, and 7, respectively, utilize a flexible fluid impermeable membrane or bag to physically separate the stored oil from sea water. However, in each embodiment, the floating oil storage system 100A, 100B, 100C, 100D, 100E, 100F defines or is provided in the form of a hull of a floating spar platform.

Figure 2:
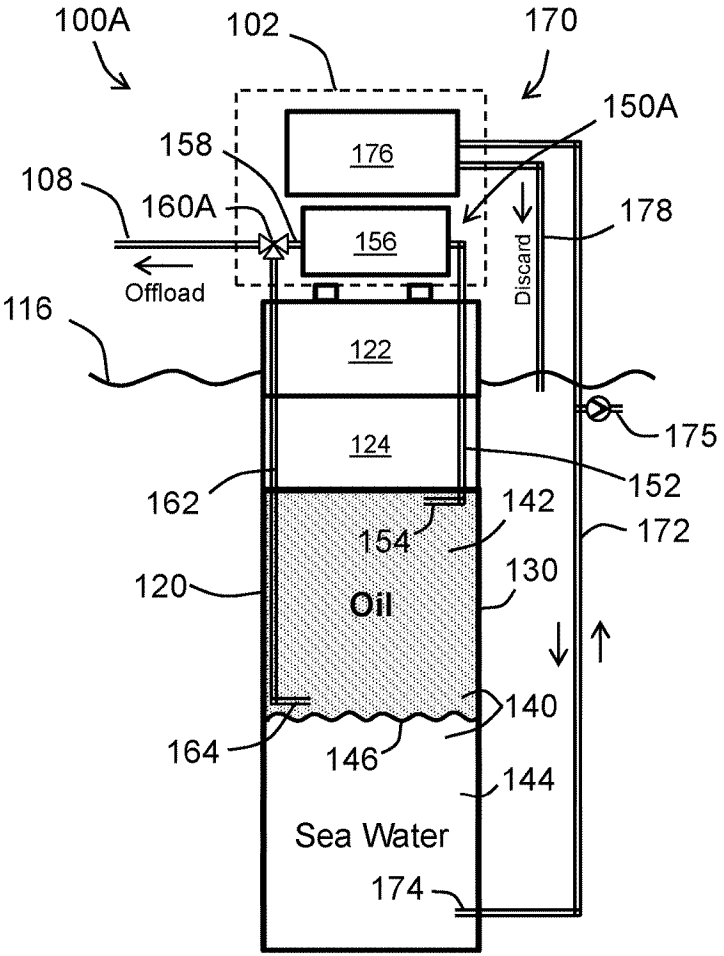
FIG. 2 is an enlarged schematic cross-sectional side view of the oil storage system of FIG. 1.

Referring now to FIG. 2, a floating oil storage system 100A that can be used as system 100 of FIG. 1 is shown. In this embodiment, system 100A includes a spar-type hull 120, an oil heating and circulation system 150A, and a ballast water system 170. Hull 120 supports oil heating and circulation system 150A, ballast water system 170, and other equipment, which can be positioned on work deck 102 (schematically shown in FIG. 2) mounted atop hull 120.

Hull 120 includes a plurality of vertically stacked compartments defined by an outer wall (e.g., a cylindrical wall) and a plurality of vertically-spaced generally horizontally oriented bulkheads. In this embodiment, hull 120 includes three tanks or compartments, each compartment having a fixed volume therein. In particular, hull 120 includes an upper tank or compartment 122 filled with air (or another gas) at or proximal the upper end of hull 120, a variable ballast tank or compartment 124 immediately below upper compartment 122, and a lower tank or compartment 130 disposed below compartments 122, 124. Thus, variable ballast compartment 124 is vertically positioned between compartments 122, 130. Lower compartment 130 stores oil, and thus, may also be referred to herein as a storage compartment or storage tank. Compartment 122 is a sealed chamber filled with a gas, such as air, and thus, provides buoyancy to hull 120 and system 100A. Variable ballast compartment 124 is selectively and controllably filled with a variable combination of sea water and air (or another gas) to provide adjustable buoyancy to system 100A. Accordingly, compartments 122, 124 may be described as buoyancy compartments.

In this embodiment, oil storage compartment 130 has an internal volume or cavity 140 that is controllably and selectively filled with a variable combination of oil and sea water. Due to the lower density of oil as compared to sea water, the oil generally floats directly on top of the sea water within cavity 140, and thus, may generally be described as an oil-over-water arrangement. As a result, cavity 140 within storage compartment 130 may be described as being divided between an upper portion or zone 142 filled with oil, and a lower portion or zone 144 filled with sea water. The oil in oil zone 142 and the sea water in zone 144 contact at a horizontally oriented oil-water interface 146. Over time, the position of interface 146, and hence the volume of each zone 142, 144, may change as the volume of stored oil in oil zone 142 increases or decreases (e.g., during influx of oil from transfer line 106 or while offloading of oil to vessel 110). Thus, when oil is added to cavity 140, oil zone 142 enlarges, interface 146 moves downward, and water zone 144 shrinks as sea water in cavity 140 is displaced by incoming oil and is removed via ballast water system 170; and when oil is removed from cavity 140, oil zone 142 shrinks, interface 146 moves upward, and water zone 144 enlarges as sea water is drawn or pumped into cavity 140 via ballast water system 170.

In embodiments described herein that employ oil-over-water storage arrangements (e.g., systems 100A, 100B, 100C), the position of the oil-water interface (e.g., interface 146) is determined and monitored over time. In general, the position of the oil-water interface can be determined by any suitable method or system known in the art. For example, a sensor can be used to measure the position of the oil-water interface. As another example, the position of the oil-water interface can be calculated at any given time based on the size and geometry of cavity 140 and the volume of oil in cavity 140 based on tracking of the flow in and flow out of oil over time.

Variable ballast compartment 124 is used to control the draft of hull 120 (i.e., the depth to which hull 120 extends) during production and oil storage operations. For example, the relative volumes of sea water and air in variable ballast compartment 124 can be controlled as the relative volumes of oil and sea water in storage compartment 130 change to compensate for the density differences between oil and water. At least in the embodiment shown in FIG. 2, compartments 122, 124, 130 and the remainder of hull 120 are designed such that storage compartment 130 is completely submerged below the surface 116. With oil zone 142 located below sea level 116, the density difference between the oil and sea water helps to push the oil in oil zone 142 upward within cavity 140.

Referring still to FIG. 2, ballast water system 170 controls the flow of water into and out of ballast compartment 124 (e.g., pumps ballast water), monitors the composition of the ballast water exiting ballast compartment 124, and treats the ballast water exiting compartment 130 to remove oil (and other potential contaminants) to avoid dumping oil and any other contaminants into the sea. In this embodiment, system 170 includes a water conduit or delivery line 172 (e.g., tubing or piping), water monitor and treatment equipment 176, and a discharge line 178. Water delivery line 172 includes a water port 174 and an inlet port 175 provided with a check valve. Water port 174 is positioned in compartment 130 at (or proximal) the bottom of storage compartment 130 and within zone 144. In embodiments described herein, the water port (e.g., water port 174) is positioned in the oil storage compartment (e.g., storage compartment 130) at a distance measured vertically from the bottom of the oil storage compartment that is preferably less than 20% of the total height of the oil storage compartment measured vertically from the bottom to the top of the oil storage compartment, and more preferably less than 10% of the total height of the oil storage compartment measured vertically from the bottom to the top of the oil storage compartment. For example, if the oil storage compartment has a total vertical height of 15 m measured from the bottom to the top of the oil storage compartment, the water port is preferably positioned within 3.0 m of the bottom of the oil storage compartment, and more preferably within 1.5 m of the bottom of the oil storage compartment (measured vertically from the bottom of the oil storage compartment). Water can enter or exit compartment 130 and zone 144 of cavity 140 therein via water port 174. Inlet port 175 and the associated check valve allow sea water to be drawn into compartment 130 and zone 144 of cavity 140 therein; however, the check valve at inlet port 175 prevents water from exiting inlet port 175 into the surrounding sea. In this embodiment, inlet port 175 is located near sea level for ease of maintenance.

In some embodiments, the flow of water through system 170 is controlled indirectly by pumps that deliver oil to or remove oil from zone 142, thereby displacing water from zone 174 via port 174 or drawing water into zone 174 via inlet 175, respectively. Alternatively, ballast water system 170 can include pumps to aid or govern the flow of water to and from zone 144 in compartment 130. In either case, water removed from zone 144 passes through water port 174 and line 172 to equipment 176, which removes oil and any contaminants from the water, and then discharges the conditioned and treated water into the sea via discharge line 178.

Referring still to FIG. 2, oil heating and circulation system 150A includes an oil suction line 152 for flowing oil in oil zone 142 from cavity 140, an oil heater 156 disposed along suction line 152 outside of hull 120, a discharge line 158 extending from heater 156, a distribution valve 160A disposed along discharge line 158, and an oil return line 162 extending from valve 160A. Suction line 152 has an inlet 154 disposed in cavity 140 and positioned at or proximal the top of cavity 140 and within zone 142. In embodiments described herein, the oil inlet (e.g., inlet 154) of the oil suction line (e.g., line 152) is positioned in the oil storage compartment (e.g., storage compartment 130) at a distance measured vertically from the top of the oil storage compartment that is preferably less than 20% of the total height of the oil storage compartment measured vertically from the bottom to the top of the oil storage compartment, and more preferably less than 10% of the total height of the oil storage compartment measured vertically from the bottom to the top of the oil storage compartment. For example, if the oil storage compartment has a total vertical height of 15 m measured from the bottom to the top of the oil storage compartment, the oil inlet of the oil suction line is preferably positioned at a distance of 3.0 m or less from the top of the oil storage compartment, and more preferably positioned at a distance of 1.5 m or less from the top of the oil storage compartment (measured vertically from the top of the oil storage compartment).

As previously described, sea water urges oil in oil zone 142 upward within cavity 140, and thus, urges oil in cavity 140 toward inlet 154. This ensures oil suction line 152 is pulling oil (as opposed to sea water) from cavity 140. Heater 156 receives oil from line 152, heats the oil, and outputs the heated oil to discharge line 158. In this embodiment, heater 156 is provided with a pump that facilitates the circulation of oil though system 150A. Valve 160A is coupled to offloading line 108 and return line 162. In particular, valve 160A has a first or recirculation position with discharge line 158 in fluid communication with return line 162 and offloading line 108 not in fluid communication with discharge line 158, and a second or offloading position with discharge line 158 in fluid communication with offloading line 108 and return line 162 not in fluid communication with discharge line 158. Thus, valve 160A is a three-way valve. In some embodiments, valve 160A permits simultaneous fluid communication of heated oil to both offloading line 108 and return line 162. Return line 162 has an outlet 164 disposed in cavity 140 vertically above water port 174 and vertically below inlet 154. The fixed vertical location of outlet 164 is preferably within or below oil zone 142, and more preferably at or proximal a predetermined targeted location for the oil-water interface 146. In this embodiment, outlet 164 is vertically positioned at or proximal the middle of cavity 140. In this embodiment, the oil outlet (e.g., outlet 164) of the oil return line (e.g., return line 162) is preferably positioned in the oil storage compartment (e.g., storage compartment 130) at a distance measured vertically from the bottom of the oil storage compartment that is 40-60% of the total height of the oil storage compartment measured vertically from the bottom to the top of the oil storage compartment. For example, if the oil storage compartment has a total vertical height of 15 m measured from the bottom to the top of the oil storage compartment, the outlet of the oil return line is preferably positioned at a distance between 6 m and 9 m measured vertically from the bottom of the oil storage compartment. In addition, outlet 164 is horizontally-opposed inlet 154. In other words, outlet 164 is positioned on the opposite lateral side of cavity 140 as compared to inlet 154.

As shown in FIG. 2, in this embodiment, suction line 152 and return line 162 both extend vertically through compartments 122, 124, 130, which functions to isolate and insulate these lines 152, 162 from the sea water surrounding hull 120, thereby reducing loss of thermal energy from the oil flowing through lines 152, 162. As used herein, the term "line" may be used to refer to any type of piping, tubing, hose, or any tubular structure capable of transporting a fluid (e.g., oil). Some of the lines 152, 158, 108, 106, 162, etc. may have different configurations or material compositions. In this embodiment, inlet 154 and outlet 164 are simply open ends of the corresponding lines 152, 162, respectively. However, in other embodiments, the inlet and/or outlet (e.g., inlet 154 and/or outlet 164) include an increasing diameter, a decreasing diameter, a particular nozzle fitting attached to pipe, or a filter, as examples.

To maintain a desired or predetermined temperature or viscosity of oil in zone 142, system 150A is operated in a heating and recirculation mode with valve 160A in the circulation position, thereby allowing relatively cool oil in the upper portion of zone 142 to be drawn through suction line 152 into heater 156. The oil from line 152 passes though heater 156, where it is heated. Next, heated oil from heater 156 is circulated through valve 160A and return line 162 back into cavity 140. After discharging heated oil from outlet 164 into cavity 140, the heated oil rises through zone 142, heating and circulating the cooler oil already present in zone 142. The lower elevation of discharge outlet 164 as compare to the top of zone 142 and inlet 154 allows the heated oil to flow upwards through zone, thereby encouraging the cooler oil in zone 142 to move upwards via natural convection or by fluid speed and direction from outlet 164. To offload oil to tanker 110, valve 160A is transitioned to the offloading position to place discharge line 158 in fluid communication with line 108, and the pump of heater 156 is operated to pull oil in the upper portion of zone 142 through suction line 152, pass it through heater 156 and valve 160A into offloading line 108. During offloading operations, the heater 156 may be used to heat the oil passing therethrough, or may be shut off and only operated as a pump.

Figure 3:
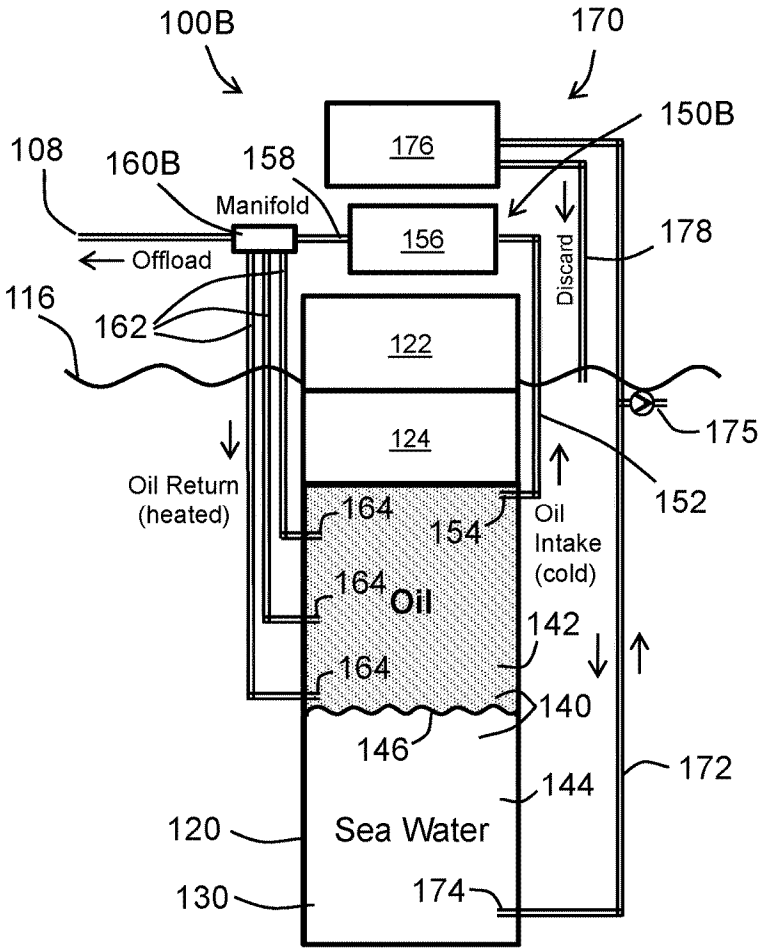
FIG. 3 is an enlarged schematic cross-sectional side view of an embodiment of an oil storage system in accordance with the principles disclosed herein.

Referring now to FIG. 3, another embodiment of a floating oil storage system 100B that can be used as system 100 of FIG. 1 is shown. In this embodiment, storage system 100B includes a spar-type hull 120, an oil heating and circulation system 150B, and a ballast water system 170. Hull 120 and ballast water system 170 are each as previously described.

Oil heating and circulation system 150B includes many of the same features as system 150A previously described. In particular, system 150B includes suction line 152 with inlet 154, oil heater 156, and discharge line 158, each as previously described. However, in this embodiment, distribution valve 160A is replaced with a distribution valve 160B, and the single return line 162 is replaced with a plurality of return lines 162. Similar to valve 160A previously described, valve 160B has an inlet port coupled to discharge line 158 and one outlet port coupled to offloading line 108, however, in this embodiment, valve 160B also includes a plurality of outlet ports coupled to the plurality of return lines 162. Thus, one of the outlet ports of valve 160B is coupled to offloading line 108, while each of the remaining outlet ports of valve 160B is coupled to one of the return lines 162. During oil heating and circulation, valve 160B receives heated oil from discharge line 158 and selectively delivers it to one of the lines 108, 162. In addition, in this embodiment, outlet 164 of each return line 162 is disposed at a different vertical location within cavity 140; however, all of the outlets 164 are positioned vertically above water port 174 and below inlet 154. The location of each outlet 164 is either within or below oil zone 142, depending on the amount of oil in compartment 130.

In this embodiment, lines 152, 162 do not extend vertically through chambers 120, 130, but rather, extend along the outside of hull 120 through the sea water, and then pass through the outer wall of hull 120 into cavity 140. To prevent heat loss from the oil in lines 152, 162, each is provided with insulation.

In general, the modes of operation of system 150B are similar to the modes of operation of system 150A previously described. In particular, during offloading operations, valve 160B is configured to direct oil from heater 156 and discharge line 158 to line 108, and during heating and recirculation operations, valve 160B is configured to return heated oil from heater 156 and discharge line 158 through one of the return lines 162 to cavity 140. However, unlike system 150A, in this embodiment, the position of valve 160B during heating and recirculation is based on the position of the oil-water interface 146. In particular, valve 160B is positioned to return heated oil to cavity 140 via the return line 162 that is vertically positioned closest to interface 146 within zone 142 (i.e., above interface 146 but as close as possible to interface 146). Returning the heated oil to cavity 140 at a selected location that is closest to interface 146 enhances the vertical circulation distance of the heated oil through zone 142 (e.g., the heated oil can circulate from the bottom of zone 142 to the top of zone 142) while reducing the potential for any oil to exit cavity 140 via water port 174.

Although valve 160B is described as selectively allowing fluid communication between discharge line 158 and only one return line 162 or with offloading line 108 at any given time, in other embodiments, the valve (e.g., valve 160B) allows simultaneous fluid communication between the discharge line (e.g., line 158) and more than one return line (e.g., return line 162) and/or the offloading line (e.g., line 108). For example, in some embodiments, valve 160B is configured to allow fluid communication between discharge line 158 and (i) one return line 162 at-a-time, (ii) multiple return lines 162 simultaneously to discharge heated oil at multiple elevations within cavity 140, and (iii) communicate with all return lines 162 simultaneously.

Figure 4:
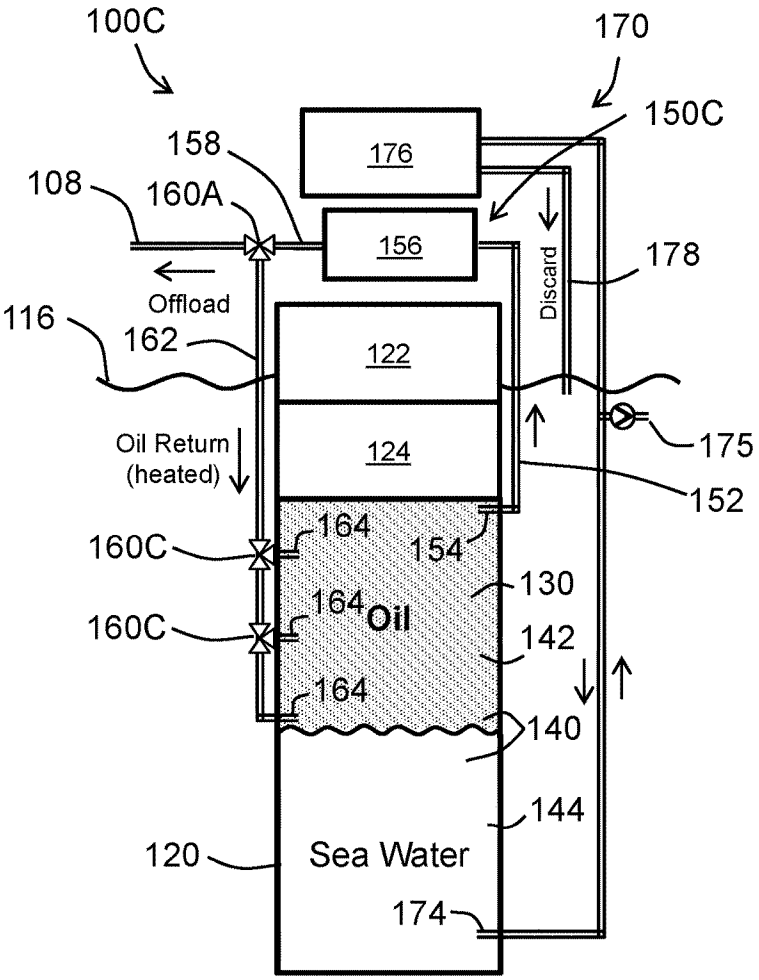
FIG. 4 is enlarged schematic cross-sectional side view of an embodiment of an oil storage system in accordance with the principles disclosed herein.

Referring now to FIG. 4, yet another embodiment of a floating oil storage system 100C that can be used as system 100 of FIG. 1 is shown. In this embodiment, storage system 100C includes a spar-type hull 120, an oil heating and circulation system 150C, and a ballast water system 170. Hull 120 and ballast water system 170 are each as previously described.

Oil heating and circulation system 150C includes many of the same features as system 150A previously described. In particular, system 150C includes suction line 152 with inlet 154, oil heater 156, discharge line 158, and valve 160A, each as previously described. However, unlike system 150A previously described in which return line 162 includes a single outlet 164, in this embodiment, return line 162 includes a plurality of vertically spaced outlets 164. Each outlet 164 is positioned within cavity 140 below inlet 154 and above water port 174. The location of each outlet 164 is either within or below oil zone 142, depending on the amount of oil in storage compartment 130. In addition, in this embodiment, a plurality of valves 160C are provided along return line 162, each valve 160C selectively controls fluid communication between return line 162 and one of the outlets 164. In particular, each valve 160C has an open position allowing fluid communication between return line 162 and the corresponding outlet 164, and a closed position preventing fluid communication between return line 162 and the corresponding outlet 164. Thus, valves 160C control which outlet 164 of line 162 returns heated oil to cavity 140.

Similar to system 150B including multiple return lines 162, the inclusion of multiple valves 160C and corresponding outlets 164 along a single return line 162 in system 150C enables the controlled return of heated oil from heater 156 and valve 160A to a selected elevation within cavity 140.

In general, the modes of operation of system 150C are similar to the modes of operation of system 150A previously described. In particular, during offloading operations, valve 160A is configured to direct oil from heater 156 to line 108, and during heating and recirculation operations, valve 160A is configured to return heated oil from heater 156 and discharge line 158 through return line 162 to cavity 140. However, unlike system 150A, in this embodiment, the position of each valve 160C during heating and recirculation is based on the position of the oil-water interface 146. In particular, valves 160C are positioned to return heated oil to volume via the outlet 164 that is vertically positioned closest to interface 146 within zone 142 (i.e., above interface 146 but as close as possible to interface 146). As previously described, returning the heated oil to cavity 140 at such a locations enhances the vertical circulation distance of the heated oil through zone 142 (e.g., the heated oil can circulate from the bottom of zone 142 to the top of zone 142) while reducing the potential for any oil to exit cavity 140 via water port 174.

Figure 5:
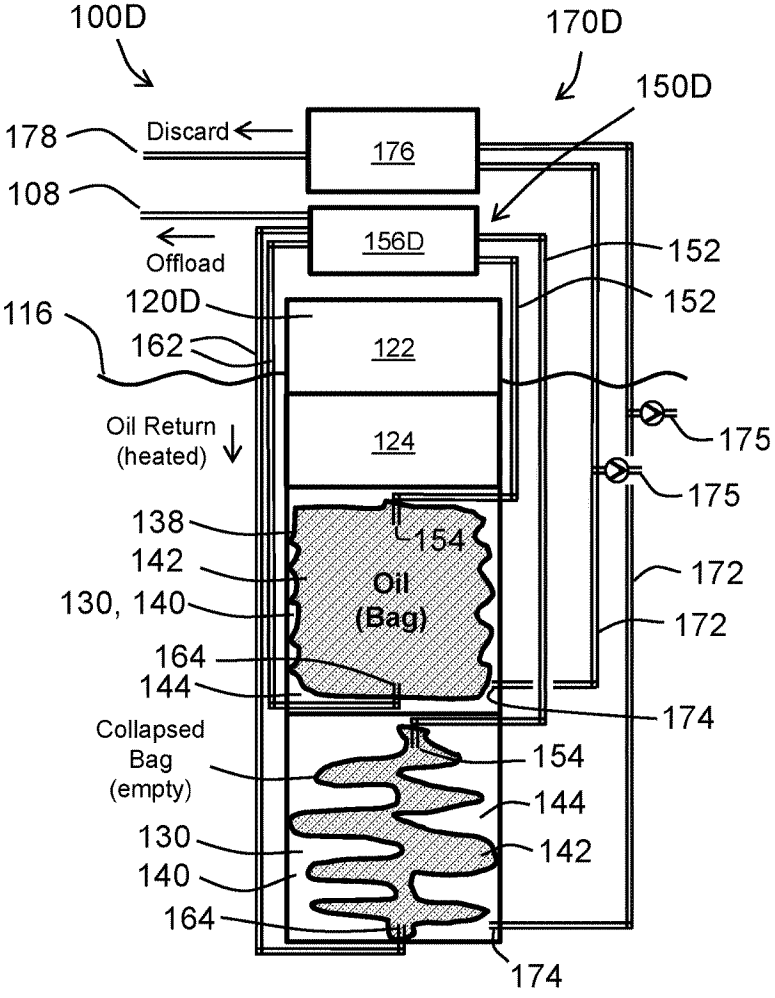
FIG. 5 is enlarged schematic cross-sectional side view of an embodiment of an oil storage system in accordance with the principles disclosed herein.

Referring now to FIG. 5, yet another embodiment of a floating oil storage system 100D that can be used as system 100 of FIG. 1 is shown. In this embodiment, floating oil storage system 100D includes a spar-type hull 120D, an oil heating and circulation system 150D, and a ballast water system 170D.

Hull 120D is substantially the same as hull 120 previously described except that hull 120D includes a plurality vertically stacked oil storage compartments 130 and a flexible oil storage membrane or bag 138 within cavity 140 of each compartment 130. Each oil bag 138 physically isolates and separates the oil stored in the corresponding cavity 140 (within the bag 138) from the sea water in the corresponding cavity 140, which surrounds the bag 138. Thus, the inside of each bag 138 defines the oil zone 142 of cavity 140 and the portion of cavity 140 outside the bag 138 defines the water zone 144 of cavity 140. In general, bags 138 can be made of any suitable flexible, fluid impermeable material known in the art for storing oil in an offshore environment including, without limitation, geosynthetic materials, rubber, or the like.

Ballast water system 170D is substantially the same as system 170 previously described except that system 170D includes a water delivery line 172 for each cavity 140. In particular, each water delivery line 172 includes a water port 174 and an inlet port 175 provided with a check valve. Each water port 174 is positioned in a corresponding oil storage compartment 130 at (or proximal) the bottom of that storage compartment 130 in zone 144. In embodiments described herein, the water port (e.g., water port 174) is positioned in the corresponding oil storage compartment (e.g., storage compartment 130) at a distance measured vertically from the bottom of the corresponding oil storage compartment that is preferably less than 20% of the total height of the corresponding oil storage compartment measured vertically from the bottom to the top of the corresponding oil storage compartment, and more preferably less than 10% of the total height of the corresponding oil storage compartment measured vertically from the bottom to the top of the corresponding oil storage compartment. For example, if each oil storage compartment has a total vertical height of 15 m measured from the bottom to the top of the oil storage compartment, each water port is preferably positioned within 3.0 m of the bottom of the corresponding oil storage compartment, and more preferably within 1.5 m of the bottom of the corresponding oil storage compartment (measured vertically from the bottom of the corresponding oil storage compartment).

Inlet ports 175 and the associated check valves allow sea water to be drawn into the corresponding zones 144 and compartments 130; however, the check valves prevent water from exiting inlet ports 175 into the surrounding sea. Each inlet port 175 is located near sea level for ease of maintenance. Water removed from each zone 144 passes through the corresponding port 174 and line 172 to equipment 176, which removes oil and any contaminants from the water, and then discharges the conditioned and treated water into the sea via discharge line 178.

In this embodiment, the central region of the upper end and the central region lower end of each bag 138 is fixably attached to the upper and lower bulkheads, respectively, that define the corresponding compartment 130. Accordingly, each bag 138 can collapse radially inward when oil is removed therefrom and sea water passes through the water port 174 to fill the space within the corresponding cavity 140 around the bag 138 (e.g., zone 144), and each bag 138 can expand radially outward when oil is added thereto and sea water passes from the corresponding cavity 140 around the bag 138 (e.g., zone 144) through water port 174 as it is displaced by the oil being added to cavity 140 (within bag 138). Bag 138 and oil zone 142 therein reaches full storage when it is expanded radially into contact with the outer walls of hull 120D.

Referring still to FIG. 5, oil heating and circulation system 150D includes many of the same features as system 150A previously described. In particular, for each compartment 130, system 150D includes a suction line 152 with inlet 154 and a return line 162 with an outlet 164, each as previously described. However, unlike system 150A, which does not include bags 138 and employs an oil-over-water storage arrangement, in this embodiment of system 150D, the inlet 154 of each suction line 152 is positioned within the corresponding bag 138 at or proximal the radially central portion of the upper end of the corresponding compartment 130, and the outlet 164 of each return line 162 is positioned within the corresponding bag 138 at or proximal the radially central portion of the lower end of the corresponding compartment 130. A heater 156D is also provided, however, in this embodiment, each line 108, 162 extends directly from heater 156D. In other words, a separate and distinct discharge line 158 and valve 150A are not provided in this embodiment. Rather, the functionality of discharge line 158 and valve 150A are integral with heater 156D. Thus, heater 156D can be operated to selectively supply heated oil to one or more of lines 162, 108. In this embodiment, suction lines 152 and return lines 162 extend vertically along the outside of hull 120, and thus, are insulated to reduce the transfer of thermal energy from oil flowing therethrough and the surrounding sea water.

In general, the modes of operation of system 150D are similar to the modes of operation of system 150A previously described. In particular, during offloading operations, heater 156D is configured to direct oil from heater 156D to line 108, and during heating and recirculation operations, heater 156D is configured to return heated oil from heater 156D through one or both return lines 162 to the corresponding bag(s) 138 within volume(s) 140.

Figure 6:
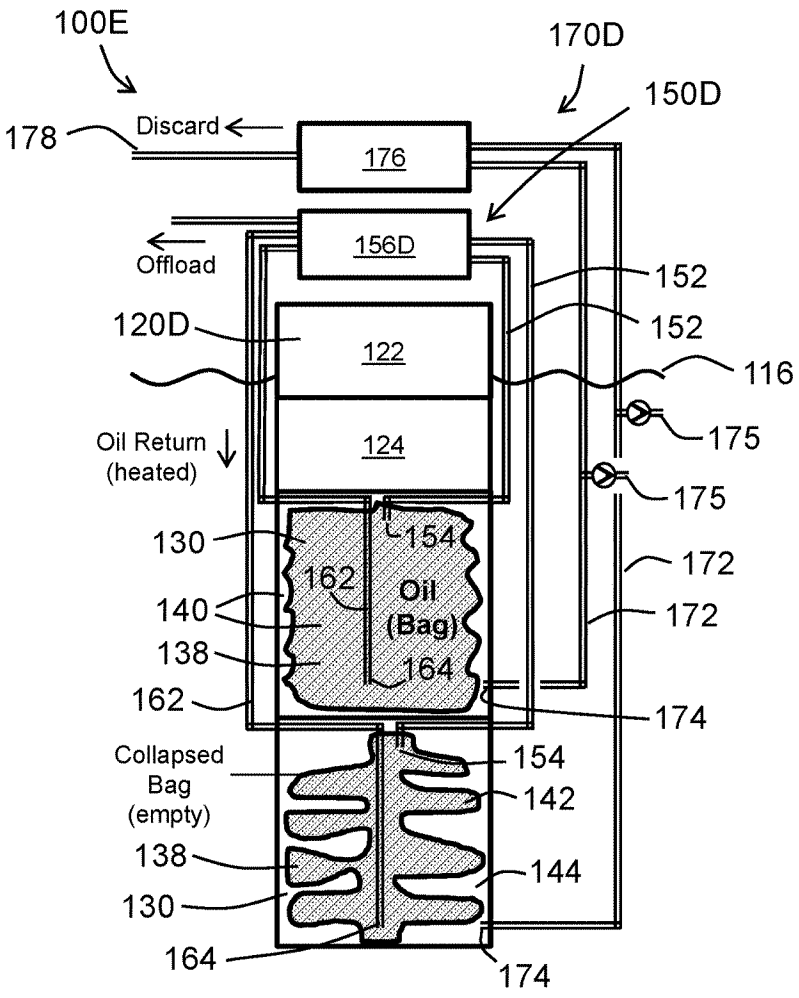
FIG. 6 is enlarged schematic cross-sectional side view of an embodiment of an oil storage system in accordance with the principles disclosed herein.

Referring now to FIG. 6, yet another embodiment of a floating oil storage system 100E that can be used as system 100 of FIG. 1 is shown. In this embodiment, floating oil storage system 100E includes a spar-type hull 120D, an oil heating and circulation system 150E, and a ballast water system 170D. Hull 120D and system 170D are each as previously described.

Heating and circulation system 150E is substantially the same as system 150D previously described except that each return line 162 passes through the top of the corresponding bag 138 and extends downward therethrough to the corresponding outlet 164, which is positioned within the corresponding bag 138 at or proximal the radially central portion of the lower end of the corresponding compartment 130.

Figure 7:
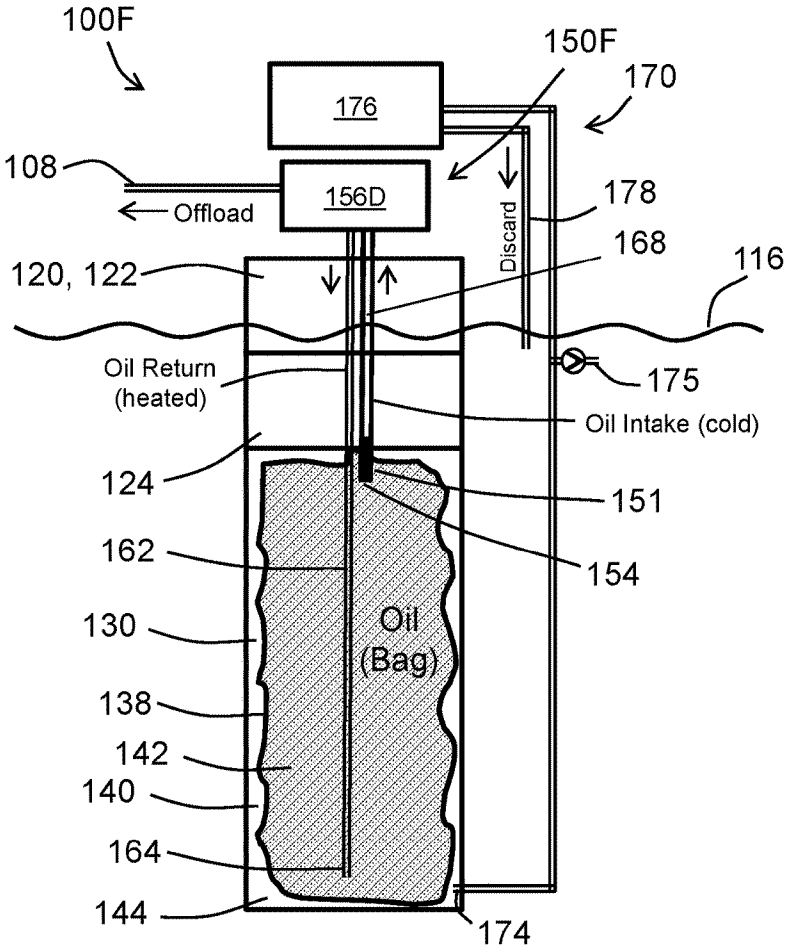
FIG. 7 is enlarged schematic cross-sectional side view of an embodiment of an oil storage system in accordance with the principles disclosed herein.

Referring now to FIG. 7, yet another embodiment of a floating oil storage system 100F that can be used as system 100 of FIG. 1 is shown. In this embodiment, floating oil storage system 100F includes a spar-type hull 120, an oil heating and circulation system 150F, and a ballast water system 170. Hull 120 and system 170 are each as previously described. Thus, in this embodiment, only one compartment 130 is provided. Similar to systems 100D, 100E, a bag 138 is provided in cavity 140 of compartment 130. As previously described, bag 138 physically separates the oil stored therein from the sea water within cavity 140, and thus, bag 138 defines an oil zone 142 therein and a water zone 144 disposed about bag 138 within cavity 140. Bag 138 is the same as bags 138 previously described.

In this embodiment, the central region of the upper end bag 138 is fixably attached to the upper and lower bulkhead that defines compartment 130. Accordingly, bag 138 can collapse radially inward when oil is removed therefrom and sea water passes through the water port 174 to fill the space within zone 144 of cavity 140 around bag 138, and bag 138 can expand radially outward when oil is added thereto and sea water passes from cavity 140 through water port 174 as it is displaced by the oil being added to cavity 140 (within bag 138). Bag 138 and oil zone 142 therein reaches full storage when it is expanded radially into contact with the outer walls of hull 120.

Referring still to FIG. 7, oil heating and circulation system 150F includes many of the same features as system 150E previously described. In particular, system 150F includes a suction line 168 with inlet 154 and a return line 162 with outlet 164, each as previously described. However, unlike system 150E, an electric submersible pump (ESP) 151 is provided at inlet 154 to draw oil from oil zone 142 within bag 138 and pump it to heater 156D. In addition, in this embodiment, return line 162 extends vertically through chambers 122, 124 into compartment 130 and bag 138, and suction line 168 is configured as a caisson that passes from the top of hull 120 through chambers 122, 124 into compartment 130 and bag 138. Caisson 168 (the suction line) provides a path for fluid flow to heater 156D and allows pump 151 to be easily inserted into or removed from compartment 130 for maintenance. In some embodiments, a suction line separate from caisson 168 is coupled to pump 151 and inserted into caisson 168 along with pump 151. In some embodiments, a tubular passage or caisson (e.g., caisson 168) is also provided for return line 162. In the example shown, caisson 168 and pump 151 and also return line 162 and outlet 164 are generally positioned at the radial center of a storage compartment 130.

In general, the modes of operation of system 150F are similar to the modes of operation of system 150D previously described. In particular, during offloading operations, ESP 151 pumps oil from bag 138 to heater 156D, and heater 156D is configured to direct oil from heater 156D to line 108; and during heating and recirculation operations, ESP 151 pumps oil from bag 138 to heater 156D, and heater 156D is configured to return heated oil from heater 156D through return line 162 to 138 within cavity 140.

Figure 8:
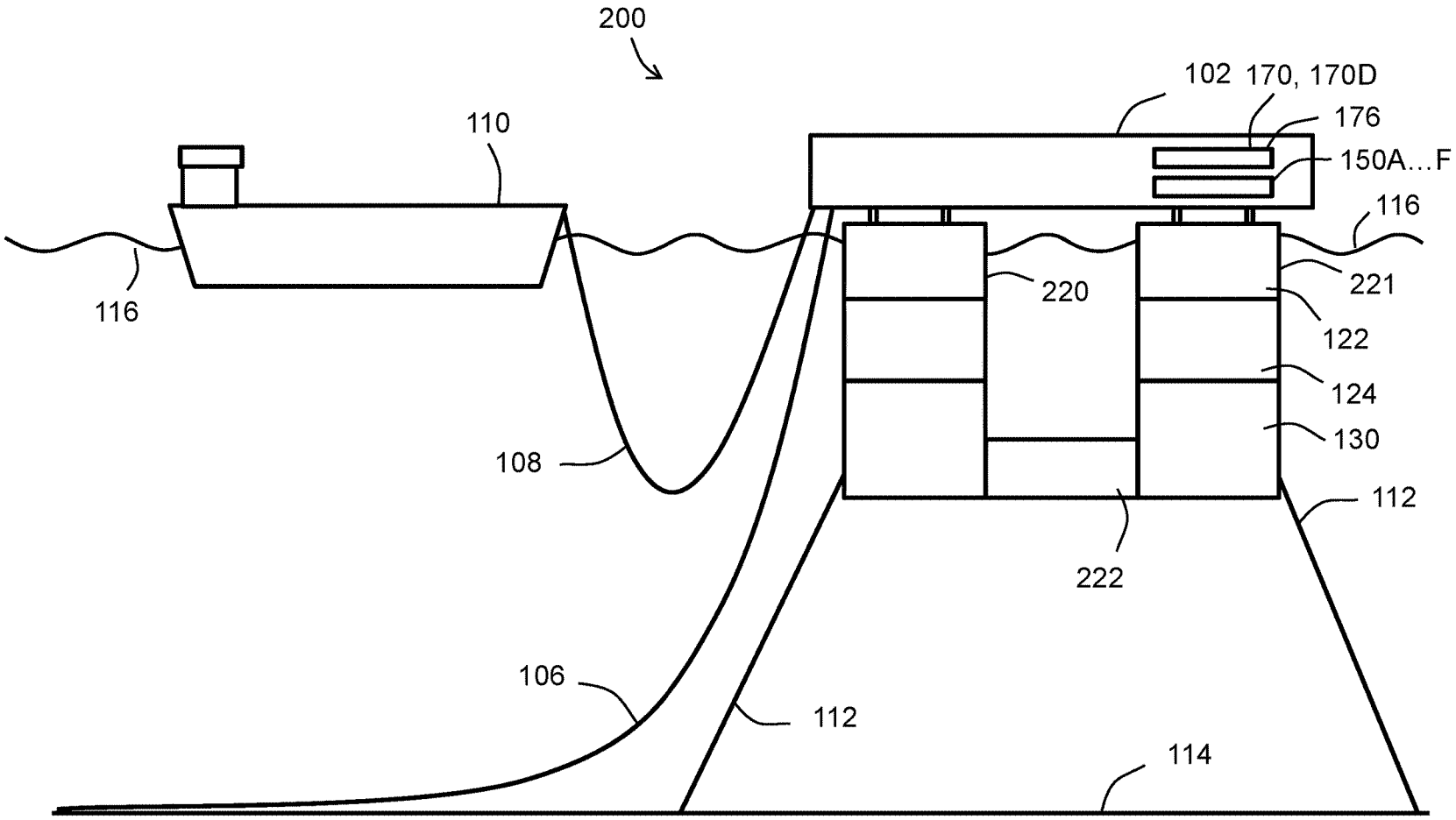
FIG. 8 is a schematic side view of an embodiment of an oil storage system in accordance with the principles disclosed herein provided in a semi-submersible platform and coupled to a tanker.

Referring now to FIG. 8, an embodiment of a floating oil production and storage system 200 is shown. In this embodiment, system 200 is substantially the same as system 100 previously described except that spar-type hull 120 is replaced with a semi-submersible hull 220. Thus, system 200 is a floating offshore structure including an adjustably buoyant semi-submersible hull 220 and a topsides or work deck 102 mounted atop hull 220. As will be described in more detail below, work deck 102 can support oil processing equipment such as an oil heater and a water monitor and treatment system for use in connection with oil and water within hull 220.

Hull 220 includes a plurality of circumferentially-spaced vertical columns 221 and a plurality of horizontal pontoons 222 coupled to the lower ends of columns 221. One pontoon 222 extends between each pair of adjacent columns 221.

Storage system 200 is coupled to a fluid transfer conduit or riser line 106 to receive oil from a subsea well or other offshore production system. Periodically, system 200 is coupled to an oil transport vessel or tanker 110 via an oil offloading conduit or line 108. System 200 is held in position with a plurality of mooring lines 112 extending from system 200 to the seafloor 114. Transfer line 106 and offloading transfer line 108 are removably installed, as needed, to transfer produced oil to and from system 200, respectively.

In the embodiments of storage systems 100 previously described (e.g., storage systems 100A-100F), the buoyancy compartments 122, 124 and the oil storage compartment(s) 130 are stacked tanks or compartments within hull 120. However, in the embodiment of system 200 shown in FIG. 8, a set of vertically stacked compartments 122, 124, 130 as previously described are provided in each column 221. An oil heating and circulation system 150 and ballast water system 170 are provided for any one or more of compartments 130. In some embodiments, one oil heater 156 and one set of equipment 176 can be shared by each compartment 130 with a suction line 152 extending from each compartment 130 to oil heater 156, one or more return lines 162 extending from discharge line 158 of oil heater 156 to each compartment 130, and a water conduit 172 extending between each compartment 130 and equipment 176. The flow of oil and water through the various lines 152, 162 and conduits 172 are selectively controlled by valves.

In general, each of the oil heating and circulation systems 150 used in connection with system 200 can be any of systems 150A, 150B, 150C, 150D, 150E, 150F as previously described, and each of the ballast water system 170 used in connection with system 200 can be any of systems 170, 170D as previously described.

Notwithstanding the arrangements shown for lines 152, 162 previously described, in general, lines 152, 162 can extend vertically along the outside of the hull (e.g., hull 120, 120D) or extend vertically through the hull to the corresponding cavity 140. In either case, the portions of lines 152, 162 extending through sea water are preferably insulated to minimize heat loss. So also the walls of hull 120 that contact sea water are preferably insulated, particularly around zone 142 or zone 144.

Although hulls 120, 120D, and columns 221 of hull 220 were described as having a gas-filed compartment 122 and a variable ballast compartment 124, in other embodiments, the hull (e.g., hull 120, 120D) or columns (e.g., columns 221) can include any number of gas-filled compartments (e.g., compartments 122) and any number of variable ballast compartments (e.g., compartments 124). Furthermore, various arrangements are contemplated for the gas-filled and variable ballast compartments. For example, although compartments 122, 124 are vertically stacked in embodiments described herein, in other embodiments, some compartment (s) (e.g., compartments 122, 124) are vertically offset while others may be horizontally offset from other compartments.

Figure 9:
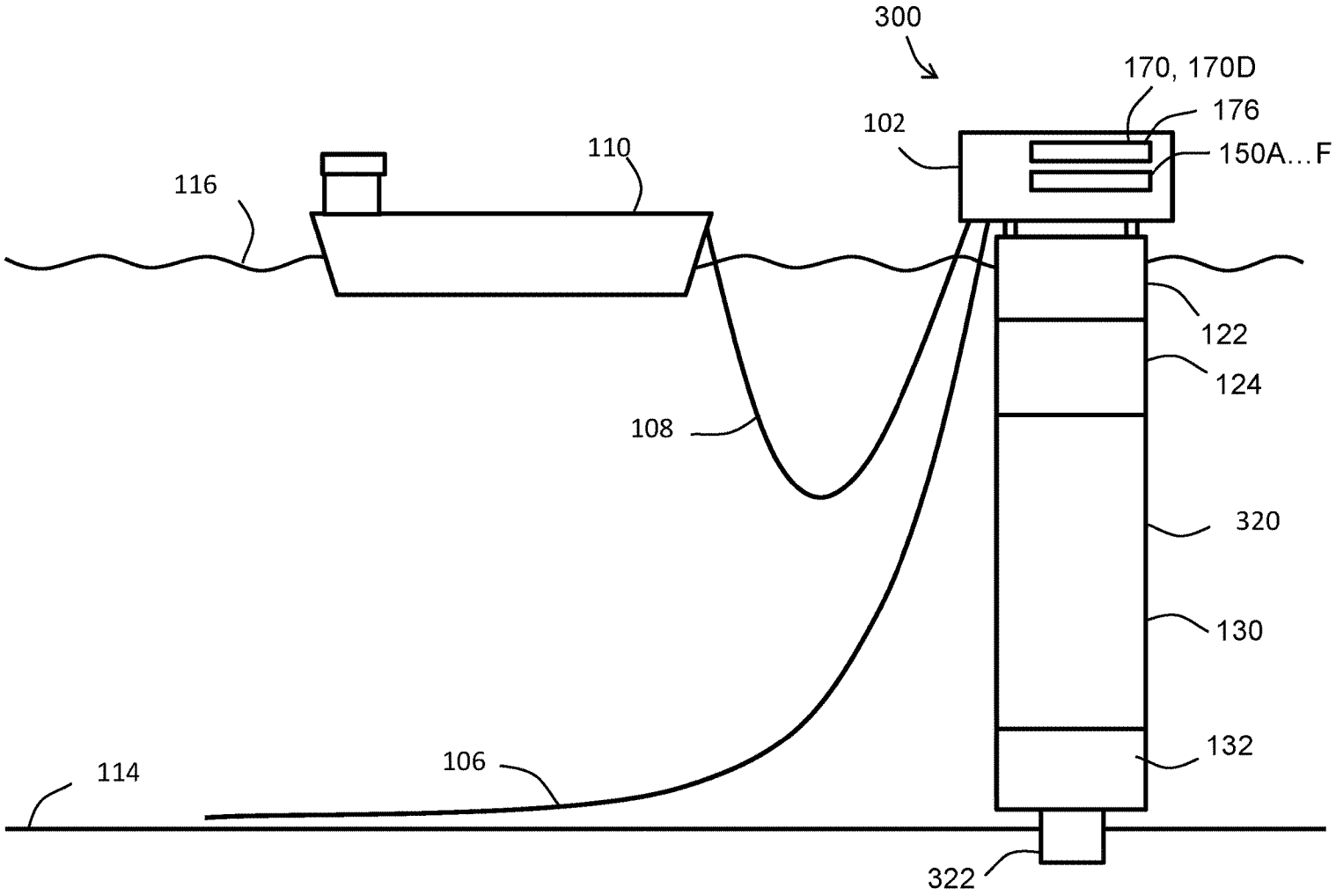
FIG. 9 is a schematic side view of an embodiment of an oil storage system in accordance with the principles disclosed herein provided in bottom founded buoyant tower platform and coupled to a tanker.

Referring now to FIG. 9, an embodiment of an offshore oil production and storage system 300 is shown. In this embodiment, system 300 is substantially the same as system 100 previously described except that spar-type hull 120 is replaced with a bottom-founded buoyant tower type hull 320. Thus, system 300 is directly coupled to the sea floor 114 but includes an adjustably buoyant hull 320 and a topsides or work deck 102 mounted atop hull 320. As will be described in more detail below, work deck 102 can support oil processing equipment such as an oil heater and a water monitor and treatment system for use in connection with oil and water within hull 320. Embodiments of hull 320 are disclosed in U.S. Pat. No. 9,758,941, which is hereby incorporated herein by reference in its entirety for all purposes. In particular, hull 320 is coupled to the sea floor 114 with an anchor 322. In this embodiment, anchor 322 is a suction pile.

Storage system 300 is coupled to a fluid transfer conduit or riser line 106 to receive oil from a subsea well or other offshore production system. Periodically, system 300 is coupled to an oil transport vessel or tanker 110 via an oil offloading conduit or line 108. System 300 is held in position with anchor 322; hull 320 can pitch about angle 322 to a limited degree. Transfer line 106 and offloading transfer line 108 are removably installed, as needed, to transfer produced oil to and from system 300, respectively.

Similar to storage systems 100 previously described (e.g., storage systems 100A-100F), the buoyancy compartments 122, 124 and the oil storage compartment(s) 130 are stacked tanks or compartments within hull 320. However, in the embodiment of system 300 shown in FIG. 9, which is bottom founded (i.e., disposed on the sea floor 114), a fixed ballast tank or compartment 132 is disposed at the lower end of hull 320 below compartments 122, 124, 130. Thus, compartments 122, 124, 130, 132 are arranged in a vertical stack. Compartments 122, 124, 130 are each as previously described. Although only one compartment 130 is shown in FIG. 9, it should be appreciated that multiple vertically stacked compartments 130 as previously described can be included between buoyancy compartments 122, 124 and fixed ballast compartment 132.

An oil heating and circulation system 150 and ballast water system 170 are provided for compartment(s) 130. In some embodiments, one oil heater 156 and one set of equipment 176 can be shared by each compartment 130 with a suction line 152 extending from each compartment 130 to oil heater 156, one or more return lines 162 extending from discharge line 158 of oil heater 156 to each compartment 130, and a water conduit 172 extending between each compartment 130 and equipment 176. The flow of oil and water through the various lines 152, 162 and conduits 172 are selectively controlled by valves.

In general, each of the oil heating and circulation systems 150 used in connection with system 300 can be any of systems 150A, 150B, 150C, 150D, 150E, 150F as previously described, and each of the ballast water system 170 used in connection with system 300 can be any of systems 170, 170D as previously described.

Notwithstanding the arrangements shown for lines 152, 162 previously described, in general, lines 152, 162 can extend vertically along the outside of the hull (e.g., hull 120, 120D) or extend vertically through the hull to the corresponding cavity 140. In either case, the portions of lines 152, 162 extending through sea water are preferably insulated to minimize heat loss. So also the walls of hull 120 that contact sea water are preferably insulated, particularly around zone 142 or zone 144.

Although hulls 120, 120D, 320 and columns 221 of hull 220 were described as having a gas-filed compartment 122 and a variable ballast compartment 124, in other embodiments, the hull (e.g., hull 120, 120D, 320) or columns (e.g., columns 221) can include any number of gas-filled compartments (e.g., compartments 122) and any number of variable ballast compartments (e.g., compartments 124). Furthermore, various arrangements are contemplated for the gas-filled and variable ballast compartments. For example, although compartments 122, 124 are vertically stacked in embodiments described herein, in other embodiments, some compartment(s) (e.g., compartments 122, 124) are vertically offset while others may be horizontally offset from other compartments.

In general, embodiments of hulls and columns described herein (e.g., hulls 120, 120D, 320, and columns 221) can include any suitable number of oil storage compartments (e.g., oil storage compartments 130). None, one, or more than one of the oil storage compartment(s) can include an oil storage bag (e.g., oil bag 138). Some embodiments configured with more than one storage tank may be configured or may be utilized to store and segregate similar or different oils from different sources.

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily mean that the particular step or operation is necessary to the method. The steps or operations of a method listed in the specification or the claims may be performed in any feasible order, except for those particular steps or operations, if any, for which a sequence is expressly stated. In some implementations two or more of the method steps or operations may be performed in parallel, rather than serially. The recitation of identifiers such as (a), (b), (c) or (1), (2), (3) before operations in a method claim are not intended to and do not specify a particular order to the operations, but rather are used to simplify subsequent reference to such operations.

What is claimed is:

1. An offshore system for storing oil, the system comprising:

a hull comprising:

a buoyancy compartment containing a gas; and an oil storage compartment disposed below the buoyancy compartment, wherein the oil storage compartment has an upper end, a lower end, and an inner cavity disposed between the upper end to the lower end, wherein the oil storage compartment is configured to store oil and water in the inner cavity;

a water port in fluid communication with the inner cavity of the oil storage compartment, wherein the water port is configured to allow water to exit the inner cavity;

an oil heating and circulation system coupled to the hull, wherein the oil heating and circulation system comprises:

a suction line having an inlet disposed in the inner cavity proximal the upper end of the oil storage compartment, wherein the inlet is configured to draw oil from the inner cavity;

an oil heater coupled to the suction line and configured to heat oil passing through the suction line; and a return line coupled to the oil heater, wherein the return line includes an outlet disposed in the inner cavity of the storage compartment, wherein the outlet is vertically positioned between the inlet of the suction line and the water port.

2. The system of claim 1, wherein the oil heating and circulation system further comprises:

a pump configured to pump oil from the inner cavity of the storage compartment through the suction line to the oil heater;

a discharge line extending from the oil heater;

a valve positioned between the discharge line and the return line, wherein the valve has a first position with the discharge line in fluid communication with the return line and a second position preventing fluid communication between the discharge line and the return line.

3. The system of claim 2, wherein the pump is an electric submersible pump coupled to the inlet and disposed in the storage compartment.

4. The system of claim 1, wherein the oil heating and circulation system comprises a plurality of return lines, wherein each return line includes an outlet disposed in the inner cavity of the storage compartment, wherein the outlet of each return line is vertically positioned between the inlet of the suction line and the water port, and wherein the outlets of the plurality of return lines are vertically spaced apart within the inner cavity of the storage compartment.

5. The system of claim 1, further comprising a flexible oil storage bag disposed in the inner cavity of the storage compartment, wherein the inlet of the suction line and the outlet of the return line are disposed in the bag.

6. The system of claim 1, wherein the return line includes a plurality of outlets disposed in the inner cavity of the storage compartment, wherein each outlet is vertically positioned between the inlet of the suction line and the water port, and wherein the plurality of outlets are vertically spaced apart within the inner cavity of the storage compartment.

7. The system of claim 1, further comprising a ballast water system coupled to the hull, wherein the ballast water system includes a water conduit, water treatment equipment coupled to the water conduit, and a discharge line coupled to the water treatment equipment, wherein the water conduit is configured to flow water from the water port to the water treatment equipment and the discharge line is configured to discharge water from the water treatment equipment.

8. The system of claim 1 further comprising a ballast water system coupled to the hull, wherein the water ballast system comprises:

water monitor and treatment equipment; and a water conduit extending from the water port to the water monitor and treatment equipment.

9. A method for heating and circulating oil stored in an offshore structure, the method comprising:

(a) pumping oil stored in an inner cavity of a storage compartment disposed in the offshore structure to a heater disposed on the offshore structure, wherein water is disposed with the oil in the inner cavity of the storage compartment;

(b) heating the oil with the heater during (a);

(c) returning the oil from the heater to the inner cavity of the storage compartment after (b), wherein the oil is returned to the inner cavity of the storage compartment at a location positioned vertically below a location where the oil is pumped from the inner cavity of the storage compartment;

(d) determining a vertical position of an oil-water interface between the oil in the inner cavity of the storage compartment and the water in the inner cavity of the storage compartment;

(e) selecting the location where the oil is returned to the inner cavity of the storage compartment during (c) in response to the vertical position of the oil-water interface in the inner cavity of the storage compartment.

10. The method of claim 9, further comprising adjusting the location in the inner cavity of the storage compartment where the oil is returned to the inner cavity of the storage compartment.

11. The method of claim 9, wherein the oil in the inner cavity of the storage compartment is disposed within a flexible bag positioned in the inner cavity.

12. The method of claim 11, wherein (a) comprises pumping oil stored in the flexible bag to the heater and (c) comprises returning the oil from the heater to the flexible storage bag.

13. A system for heating and circulating oil stored in an offshore structure, the system comprising:

a buoyancy compartment disposed in a floating hull;

an oil storage compartment disposed in the floating hull below the buoyancy compartment, wherein the oil storage compartment has an inner cavity configured to store oil;

an oil suction line having an inlet disposed in the inner cavity, wherein the oil suction line is configured to draw oil from the inner cavity through the inlet;

an oil heater coupled to the oil suction line and configured to heat oil passing through the oil suction line; and a return line coupled to the oil heater and including an outlet disposed in the inner cavity of the oil storage compartment, wherein the outlet is vertically positioned below the inlet of the oil suction line, wherein the return line is configured to transport oil from the oil heater to the inner cavity of the oil storage compartment.

14. The system of claim 13, wherein the inner cavity of the oil storage compartment is configured to hold water below the oil in the inner cavity.

15. The system of claim 14, further comprising a water port disposed in the inner cavity and configured to add and remove water from the inner cavity, wherein the water port is disposed below the inlet of the oil suction line and below the outlet of the oil return line.

16. The system of claim 15, further comprising a plurality of vertically spaced outlets disposed in the inner cavity of the oil storage compartment, wherein each outlet is coupled to the return line and is positioned between the water port and the inlet of the oil suction line.

17. The system of claim 13, further comprising a flexible oil storage bag disposed in the inner cavity and configured to hold the oil stored in the inner cavity, wherein an upper end of the flexible oil storage bag is fixably coupled to the floating hull and a lower end of the flexible storage bag is fixably coupled to the floating hull.

18. The system of claim 17, wherein a portion of the inner cavity disposed about the flexible oil storage bag is configured to hold water.

19. The system of claim 18, wherein the oil suction line is disposed in the flexible oil storage bag and the outlet is disposed in the oil storage bag.

* * * * *